US006267659B1

(12) United States Patent
Chen et al.

(10) Patent No.: US 6,267,659 B1
(45) Date of Patent: Jul. 31, 2001

(54) STACKED POLISH PAD

(75) Inventors: Shyng-Tsong Chen, Patterson; Michael F. Lofaro, Milton, both of NY (US); Woody Ray Smith, Essex Junction, VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/564,785

(22) Filed: May 4, 2000

(51) Int. Cl.[7] ..... B24D 11/00
(52) U.S. Cl. ..... 451/533; 451/287
(58) Field of Search ..... 451/526, 527, 451/528, 530, 532, 533, 539, 548, 285, 287

(56) References Cited

U.S. PATENT DOCUMENTS

| | | | | |
|---|---|---|---|---|
| 5,205,082 | | 4/1993 | Shendon et al. . | |
| 5,212,910 | * | 5/1993 | Breivogel et al. | 51/398 |
| 5,257,478 | * | 11/1993 | Hyde et al. | 51/131.3 |
| 5,558,563 | | 9/1996 | Cote et al. . | |
| 5,564,965 | * | 10/1996 | Tanaka et al. | 451/287 |
| 5,635,083 | | 6/1997 | Breivogel et al. . | |
| 5,643,061 | | 7/1997 | Jackson et al. . | |
| 5,664,989 | * | 9/1997 | Nakata et al. | 451/41 |
| 5,681,215 | | 10/1997 | Sherwood et al. . | |
| 5,795,215 | | 8/1998 | Guthrie et al. . | |
| 5,795,218 | * | 8/1998 | Doan et al. | 451/526 |
| 5,800,248 | | 9/1998 | Pant et al. . | |
| 5,873,769 | | 2/1999 | Chiou et al. . | |
| 5,885,135 | | 3/1999 | Desorcie et al. . | |
| 5,899,800 | | 5/1999 | Shendon et al. . | |
| 5,913,714 | | 6/1999 | Volodarsky et al. . | |

FOREIGN PATENT DOCUMENTS 06316327 9/1996 (JP) .

* cited by examiner

*Primary Examiner*—Timothy V. Eley
*Assistant Examiner*—Dung Van Nguyen
(74) *Attorney, Agent, or Firm*—Wood, Phillips, VanSanten, Clark & Mortimer

(57) ABSTRACT

A polishing pad assembly is described for use in a chemical-mechanical polishing apparatus having a polishing platen. The polishing pad assembly includes a first pad disposed on the platen. The first pad comprises a sealable enclosure with a flexible outer skin and partially filled with a porous material. A control is adapted to inject fluid into and to remove fluid from the enclosure. The first pad has a hardness which is variable according to an amount of fluid in the enclosure. A second pad is disposed on the first pad.

9 Claims, 2 Drawing Sheets

STACKED POLISH PAD

FIELD OF THE INVENTION

This invention relates to chemical-mechanical polishing of semiconductor wafers and, more particularly, to a stacked wafer polishing pad having variable hardness.

BACKGROUND OF THE INVENTION

Chemical-mechanical polishing (CMP) is performed in the processing of semiconductor wafers and/or chips on commercially available polishers. The standard CMP polisher has a polishing table carrying a circular polishing pad and a rotating carrier for holding the wafer. A slurry is used on the polishing pad.

Ideally, a CMP polisher delivers a global uniform, as well as locally planarized wafer. However, global uniformity on a wafer-to-wafer basis is difficult to achieve. Current pad designs include stacked pads in which an upper hard pad is stacked on a soft sub-pad which is disposed on a polishing platen associated with the polishing table. The hard pad may be, for example, an IC 1000 pad while the soft pad may be, for example, a Suba 4 pad. These stacked pads have functioned to improve polish uniformity. However, the stacked pads require the disposal of both pads after a certain number of wafers have been polished on the upper pad or if a sub-pad of differing compressibility is desired. It is known to replace the soft pad with a semi-permanent silicon pad of the same or similar compressibility as the Suba 4 soft pad. However, it is desirable to use a sub-pad of a material whose rigidity and pliability could be varied ex situ or in situ to achieve variable polish pad hardness.

SUMMARY OF THE INVENTION

In accordance with the invention the above desires are satisfied with a sub-pad whose rigidity and pliability is variable to achieve variable polish pad hardness.

Broadly, there is disclosed herein a polishing pad assembly for use in a chemical-mechanical polishing apparatus having a polishing platen. The polishing pad assembly includes a first pad disposed on the platen. The first pad is variably adaptable to vary hardness. Control means are operatively associated with the first pad for varying hardness of the first pad. A second pad is disposed on the first pad.

It is a feature of the invention that the first pad comprises a sealable enclosure with a flexible outer skin and partially filled with a porous material.

It is another feature of the invention that the control means comprises means for injecting a fluid into and for removing the fluid from the enclosure. The first pad has a hardness which is variable according to an amount of fluid in the enclosure.

It is still another feature of the invention that the injecting means comprises the platen being perforated and being operatively connected to a fluid delivery supply.

It is still another feature of the invention that the fluid delivery is radially variable across the first pad to radially vary hardness of the first pad.

In accordance with an alternative embodiment of the invention it is a feature of the invention that the first pad comprises a two-part laminated polymer cured to form a hard pad.

It is another feature of the invention that the control means comprises means for heating the platen to form a pliable first pad outer surface.

It is still another feature of the invention that the heating is radially variable across the first pad to radially vary hardness of the first pad.

Further features and advantages of the invention will be readily apparent from the specification and from the drawings.

DETAILED DESCRIPTION OF THE INVENTION

Figure 1:
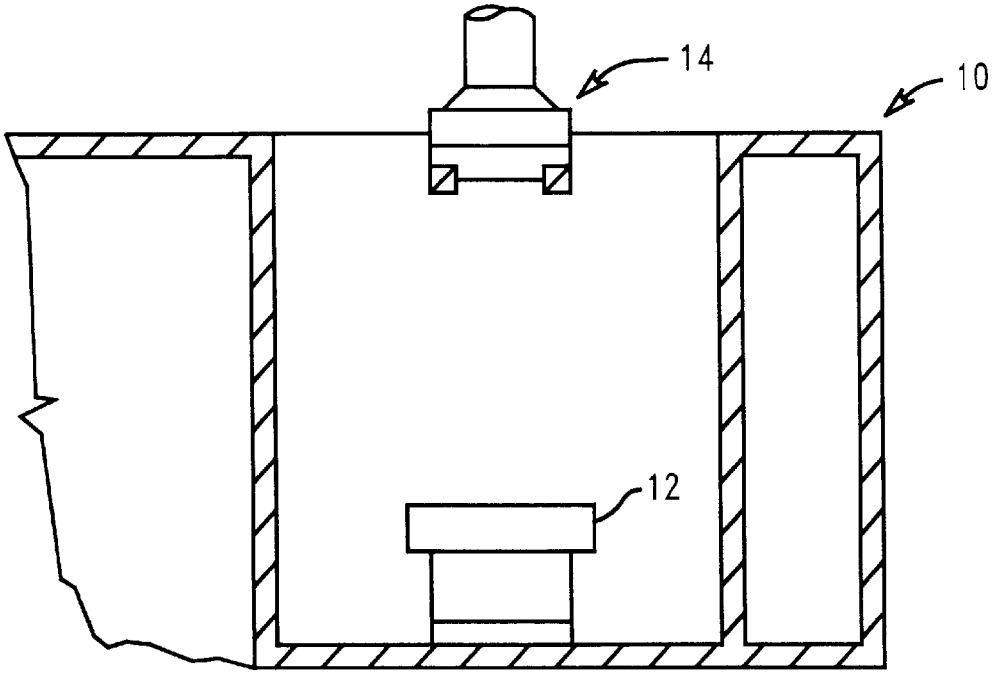
FIG. 1 is a side, partial sectional view of a chemical-mechanical polishing apparatus including a stacked wafer polishing pad having variable hardness in accordance with the invention.

Referring initially to FIG. 1, a chemical-mechanical polishing (CMP) apparatus 10 is illustrated. The CMP apparatus 10 is generally of conventional overall construction and includes a circular polishing table 12 and rotating carrier 14, although, as previously noted, it may include a wide range of design and innovative technology. In accordance with the invention, the polishing table 12 utilizes a stacked wafer polishing pad having variable hardness.

Figure 2:
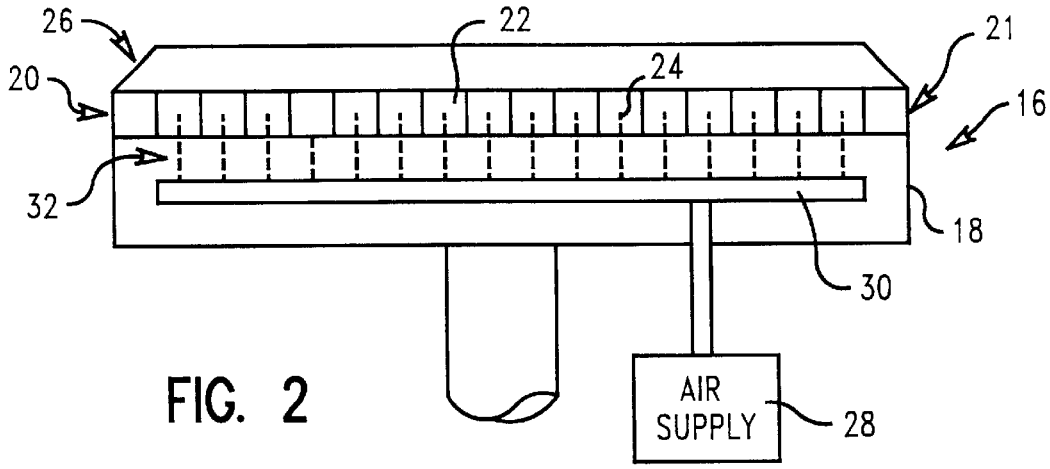
FIG. 2 is a side elevation view of the stacked wafer polishing pad in accordance with a first embodiment of the invention.

Referring to FIG. 2, a polish pad assembly 16 in accordance with a first embodiment of the invention is illustrated. The polish pad assembly 16 is for use in a CMP apparatus, such as the apparatus 10 of FIG. 1, having a polishing platen 18 associated with the polishing table 12. A first pad 20 is disposed on the platen 18. The first pad 20, also referred to as a sub-pad, is in the form, of a sealable enclosure 21 with a flexible outer skin 22 and partially filled with a porous material 24. A second, upper pad 26 is disposed on the first pad 20.

In accordance with the invention, the outer skin 22, with the platen 18, defines an air bladder and the porous material 24 comprises a foamy material encapsulated within the air bladder. The first pad 20 is placed under the second pad 26 which comprises a hard pad, and above the hard polish platen 18. The platen 18 is typically of metal or ceramic or the like. A fluid, such as air, from a controlled air supply 28, is supplied under pressure to an air manifold or plenum 30 or the like within the platen 18. The platen 18 includes perforation openings, represented by dashed lines 32, providing air passages between the manifold 30 and the first pad 20. The air pressure is retained within or bled off by the controlled air supply 28 to achieve a fixed form and rigidity for a given polish process. Particularly, in the illustrated embodiment of the polish pad apparatus 16, air injection to the encapsulated air bladder 22 is through the perforated platen 18. Alternatively, the air injection could be through the top hard polish pad 26 or through sides of the encapsulated bladder 22.

Figure 3:
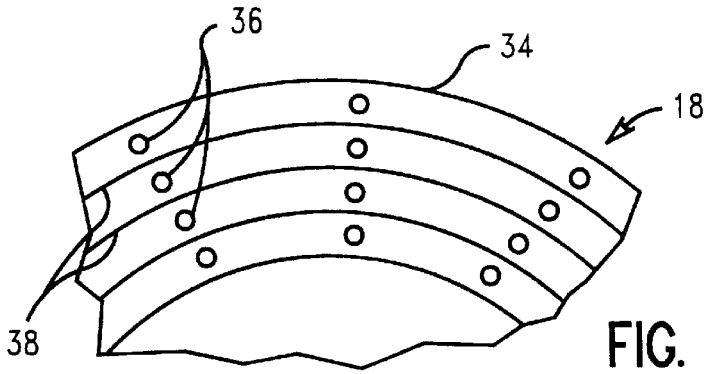
FIG. 3 is a detailed view of a portion of the polishing platen of FIG. 2.

The fluid delivery is such that a uniform form and rigidity is achieved across the entire surface of the first polish pad 20. Alternatively, the fluid pressure could be non-uniform, for example, variable over the radius of the polish pad to achieve faster polish rates at certain wafer radii and slower at others to compensate for incoming film non-uniformities, center-to-edge issues, etc. Particularly, and with reference to FIG. 3, a portion of the perforated platen 18 is illustrated proximate an outer edge 34. The perforations 32, see FIG. 2, include duct opening 36 arranged in a radially extending rows. An alignment grid represented by lines 38 are used for aligning the first pad 20 on the platen 18. The manifold 30 could be selectively controlled by any known means to provide a different amount of fluid pressure at duct openings 36 spaced different radial distances from a center axis.

In addition to the above, known in situ methods to monitor uniformity of polish, for example, through the platen 18, may be used to send uniformity information to a the air supply pressure control 28 which then adjusts the fluid pressure in situ.

Figure 4:
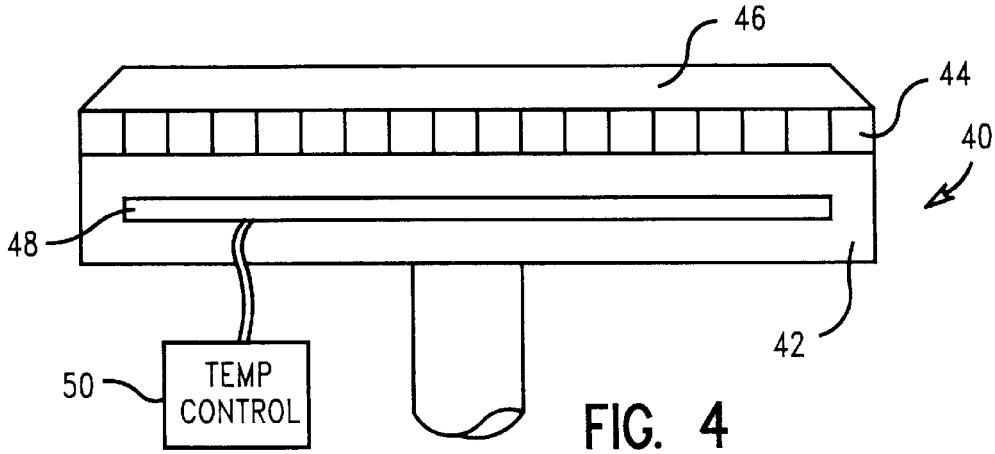
FIG. 4 is a side elevation view of the stacked wafer polishing pad in accordance with a second embodiment of the invention.

Referring to FIG. 4, a polish pad assembly 40 in accordance with another embodiment of the invention is illustrated. The polishing pad assembly 40 includes a platen 42. A first pad, or sub-pad 44 is disposed on the platen 42. A second pad 46 is disposed on the first pad 44. The first pad 44 comprises a two-part laminated polymer that is cured to form a very hard sub-pad. The first pad 44 is heated using a heating element 48 in the platen 42. The heating element 48 is controlled by a temperature control 50. When the hard sub-pad 44 is heated using the heater 48 it forms a more pliable polish surface.

The two-part laminated polymer in the first pad 44 could be formed of ENVIROTEX which creates a surface whose rigidity is temperature-dependent. This is a two-part liquid polymer coating that when firmed up via drying provides a chemically resistant, plastic-like product that is smooth as glass. At room temperature, it is a rigid as glass and can crack at flex. Once heated, for example, to polish process temperature of 100° F., it maintains its structure and smoothness, but becomes very pliable.

In accordance with the invention, the platen heating from the heating element 40 can be zoned radially such that a profiled polish pad hardness is created to improve polish uniformity.

While the stacked polish pad assemblies of FIG. 2 and FIG. 4 are removably mounted on the respective platens 18 and 42, the sub-pads may be integrated into a removable platen head. This allows the second pad 26 or 46 to be changed without changing the respective sub-pad 20 or 44. With both embodiments, the respective polishing pad assembly 16 and 40 provide adjustable sub-pad hardness.

We claim:

1. A polishing pad assembly for use in a chemical-mechanical polishing apparatus having a polishing platen, the polishing pad assembly comprising:

a first pad disposed on the platen, the first pad being variably adaptable to vary hardness wherein the first pad comprises a sealable enclosure with a flexible outer skin and partially filled with a porous material;

control means operatively associated with the first pad for varying hardness of the first pad wherein the control means comprises means for injecting a fluid into and for removing the fluid from the enclosure, wherein the first pad has a hardness which is variable according to the amount of fluid in the enclosure; and a second pad disposed on the first pad.

2. The polishing pad assembly of claim 1 wherein the injecting means comprises the platen being perforated and being operatively connected to a fluid delivery supply.

3. The polishing pad assembly of claim 1 wherein fluid delivery is radially variable across the first pad to radially vary hardness of the first pad.

4. The polishing pad assembly of claim 1 wherein the first pad comprises a two part laminated polymer cured to form a hard pad.

5. The polishing pad assembly of claim 4 wherein the control means comprises means for heating the platen to form a pliable first pad outer surface.

6. The polishing pad assembly of claim 1 wherein heating is radially variable across the first pad to radially vary hardness of the first pad.

7. A polishing pad assembly for use in a chemical-mechanical polishing apparatus having a polishing platen, the polishing pad assembly comprising:

a first pad disposed on the platen, the first pad including a sealable enclosure with a flexible outer skin and partially filled with a porous material;

means for injecting a fluid into and for removing the fluid from the enclosure; and a second pad disposed on the first pad, wherein the first pad has a hardness which is variable according to an amount of fluid in the enclosure.

8. The polishing pad assembly of claim 7 wherein the injecting means comprises the platen being perforated and being operatively connected to a fluid delivery supply.

9. The polishing pad assembly of claim 7 wherein fluid delivery is radially variable across the first pad to radially vary hardness of the first pad.

* * * * *